US009555457B2

(12) United States Patent
Bloxham

(10) Patent No.: US 9,555,457 B2
(45) Date of Patent: Jan. 31, 2017

(54) APPARATUS AND METHOD FOR FORMING A SCREW FLIGHT

(75) Inventor: Gregory John Bloxham, Beecroft (AU)

(73) Assignee: Advanced Spiral Technology Pty Limited, New South Wales (AU)

( * ) Notice: Subject to any disclaimer, the term of this patent is extended or adjusted under 35 U.S.C. 154(b) by 264 days.

(21) Appl. No.: 14/130,837

(22) PCT Filed: Jul. 5, 2012

(86) PCT No.: PCT/AU2012/000803

§ 371 (c)(1),
(2), (4) Date: Mar. 27, 2014

(87) PCT Pub. No.: WO2013/003903

PCT Pub. Date: Jan. 10, 2013

(65) Prior Publication Data

US 2014/0196515 A1 Jul. 17, 2014

(30) Foreign Application Priority Data

Jul. 5, 2011 (AU) ..... 2011902667

(51) Int. Cl.
*B21D 11/06* (2006.01)
*B21D 11/07* (2006.01)
*B21D 11/14* (2006.01)

(52) U.S. Cl.
CPC ..... *B21D 11/14* (2013.01); *B21D 11/06* (2013.01); *B21D 11/07* (2013.01)

(58) Field of Classification Search
CPC ..... B21D 11/06; B21D 11/14; B21D 11/07; B21D 53/00; B21D 5/00; B65G 33/00; B65G 33/26; B65G 33/265; B65G 2812/0527
USPC ..... 72/133, 371, 127, 146, 147, 413, 64, 65, 72/380, 384; 29/889; 198/676, 677
See application file for complete search history.

(56) References Cited

U.S. PATENT DOCUMENTS 537,461 A * 4/1895 Hewlett et al. ..... B21D 53/36 144/162.1
1,748,206 A * 2/1930 Christian ..... B21C 37/26 29/889
3,667,276 A * 6/1972 Moodey ..... B21D 11/06 29/889
4,614,105 A * 9/1986 Hisao ..... B21D 5/02 29/727

(Continued)

FOREIGN PATENT DOCUMENTS

DE 1296115 B * 5/1969 ..... B21D 11/14
GB 1 398 091 A 6/1975

(Continued)

OTHER PUBLICATIONS

International Preliminary Report on Patentability for Application No. PCT/AU2012/000803; dated Oct. 31, 2013.

(Continued)

*Primary Examiner* — Jimmy T Nguyen
*Assistant Examiner* — Gregory Swiatocha
(74) *Attorney, Agent, or Firm* — Alston & Bird LLP

(57) ABSTRACT

This invention relates to an apparatus for forming a helical screw flight from a flight blank. The apparatus includes a base and an engaging means. The engaging means is movably mounted to the base and is configured to formingly engage the blank so as to form a twist in at least a portion of the flight blank corresponding to a predetermined pitch of the flight.

8 Claims, 17 Drawing Sheets

(56) References Cited

U.S. PATENT DOCUMENTS

| | | | | |
|---|---|---|---|---|
| 4,666,033 | A | 5/1987 | Reid | |
| 4,697,321 | A * | 10/1987 | Shibuya | B21D 5/02 29/727 |
| 2010/0116013 | A1 * | 5/2010 | Brennand | B21D 22/02 72/311 |

FOREIGN PATENT DOCUMENTS

| | | | |
|---|---|---|---|
| JP | 54-131283 | A | 10/1979 |
| JP | 56-047280 | A | 4/1981 |
| WO | WO-2011/036549 | A1 | 3/2011 |

OTHER PUBLICATIONS

International Search Report and Written Opinion for Application No. PCT/AU2012/000803; dated Nov. 26, 2012.

* cited by examiner

APPARATUS AND METHOD FOR FORMING A SCREW FLIGHT

FIELD OF THE INVENTION

This invention relates generally to the field of materials handling equipment. More particularly, the present invention relates to screw or auger flights (particularly sectional flights) and to an apparatus and method of forming such flights.

BACKGROUND OF THE INVENTION

Any discussion of the prior art throughout the specification should in no way be considered as an admission that such prior art is widely known or forms part of common general knowledge in the field.

Screw or auger flights are typically used in bulk handling industries for efficiently moving fluid, granular or semi-solid material. Rotation of the flight causes the material to be conveyed along the surface of a spiralled coil section.

The means and method of manufacturing conventional sectional screw flights involves pressing each section of flight between a set of appropriately shaped dies. Each section of flight is then typically welded to a shaft in sequence to form a complete conveyor screw.

The conventional die pressing method has a number of inherent disadvantages. These disadvantages include that, depending on the thickness of the blank material used, is it often necessary to repeat the die pressing operation several times in order to conform the shape of the annulus to the shape of the dies between which the blank is pressed. The requirement to repeat the pressing cycle necessarily adds to the costs of production of screw flights produced via this method.

Furthermore, the blank typically undergoes plastic deformation during the pressing process which can lead to inaccuracy in flight profiles outside of desired manufacturing tolerances. Such variations away froth desired manufacturing tolerances necessarily lead to inferior products and a resulting reduction in product performance and lifespan.

In addition, for each particular size and pitch for a flight, two sets of dies are needed if both left and right hand flights are to be produced, further adding to the costs of using dies to form screw flights.

It is also difficult to produce accurate dies which will produce a flight of a particular size and pitch. Accordingly, it is typically necessary to use an iterative process of trial and error whereby several sets of dies are produced, tested and modified until the desired properties of a flight can be achieved from the die set.

It is an object of the present invention to overcome or ameliorate one or more of the disadvantages of the prior art, or at least to provide a useful alternative.

SUMMARY OF THE INVENTION

According to a first aspect of the invention, there is provided an apparatus for forming a helical screw flight from a flight blank, the apparatus including:

a base; and engaging means movably mounted to the base, the engaging means being configured to formingly engage the blank so as to form a twist in at least a portion of the flight blank corresponding to a predetermined pitch of the flight.

Preferably, the flight blank is in the form of an annulus, more preferably, an open ended annulus (e.g. a penannular)

wherein the annulus shaped blank has an inner diameter and an outer diameter. The engaging means is preferably adapted to twist the portion of the annulus about a mean radius line of the annulus. It will be appreciated by those skilled in the art that, by twisting the blank about its mean radius line, undesirable rounding or rolling across the cross-section of the blank is substantially avoided.

The engaging means preferably engages opposed sides of the blank such that forming movement of the engaging means forms a twist in at least a portion of the flight blank.

In some embodiments, the engaging means includes primary engaging means for engaging the blank at at least two spaced apart positions, whereby the primary engaging means is configured to cause relative movement between the at least two engaged positions so as to form the twist in the blank.

In certain preferred embodiments, the primary engaging means includes two pairs of (primary) side plates. Each side plate is preferably a die formed plate having an engaging portion such as, for example, an engaging edge or surface for engaging the blank. Each side plate is preferably. arranged so as to extend in a direction which is substantially normal to the mean radius line of the blank.

Preferably, each pair of side plates has a first fixed plate and a second movable plate, the second plate being movable relative to the fixed plate.

In some preferred embodiments, the engaging means includes secondary engaging means for engaging the blank at at least one position in between the primary engaging means. The secondary engaging means preferably engages the blank at a central or mid-point between the primary engaging means. Preferably, the secondary engaging means includes a pair of mid-plates. The mid-plates preferably include a fixed mid-plate and a movable mid-plate, the movable mid-plate being movable relative to the fixed mid-plate.

The fixed plates of both the primary and secondary engaging means are preferably mounted to a mounting means such as a mounting frame connected to the base. Preferably, the mounting means includes a receiving formation for receiving each fixed plate. The receiving formation preferably includes a pair of spaced apart channels, grooves, slots, ridges, or other suitable formation for receiving the fixed side plates, and a central receiving formation (e.g. channel) for receiving the fixed mid-plate.

Preferably, each fixed plate has a mounting formation for mounting the plate in or on or otherwise to the receiving formation. The mounting formation of each plate is preferably complementary in shape to that of the receiving formation. For example, the mounting formation and the receiving formation may be configured as a tongue-and-groove type arrangement.

In certain embodiments, securing means is provided for securing each fixed side plate in position, relative to the mounting means. The securing means preferably includes one or more locking screws for holding the mounting formation (e.g. tongue) in the associated channel. Preferably, each receiving formation is configured to enable the associated fixed plate to be selectively mounted at a desired or predetermined position along the length of the receiving formation. For example, the fixed plates can be slid along the associated channel and then locked in the desired position.

Preferably, a locking means such as, for example, a lock-bolt is provided for locking the fixed mid-plate in position, relative to the mounting means.

The movable plates of the primary engaging means and the secondary engaging means are preferably mounted to a movable frame, the frame being movably mounted to the base to enable relative movement between the fixed plates and the movable plates.

The movable frame preferably has a mounting formation for mounting the movable plates. Preferably, the mounting formation of the movable frame corresponds to (e.g. mirrors) the mounting formation of the fixed mounting frame such that the engaging portion of each pair of fixed and movable plates is substantially aligned. That is, the pairs of side plates and the pair of mid-plates are preferably in engaging alignment.

The receiving formations are preferably arranged such that the pairs of side plates are angled relative to one another. Preferably, the side plates are configured such that the relative angle therebetween is less than 180 degrees. In certain preferred embodiments, the side plates are arranged to have an angle of approximately 60 degrees therebetween. It will be appreciated that the primary engaging members are not limited to being angled at 60 degrees, but could, in other embodiments, be angled at any suitable angle less than 180 degrees. For example, the side plates can be angled at approximately 30, 45, 65, 75, 90, 105, 120, 135 or 145 degrees relative to each other.

Preferably, a support means is associated with the side plates for supporting the flight blank, in use. The support means is preferably configured to support the outer diameter of the blank. Preferably, the support means includes a first support bracket mountable to a fixed side plate of a first pair of primary engaging side plates and a second support bracket mountable to a movable side plate of a second pair of primary engaging side plates. Each support bracket is preferably selectively adjustably positionable relative to the associated side plate and secured thereto by a suitable locking means such as one or more locking elements (e.g. screws). It will be appreciated that the support brackets can be selectively mounted to the desired side plates, depending on whether a right-hand or left-hand helical screw flight is to be formed by the apparatus.

The moveable frame is preferably moved by an actuating means. The actuating means preferably includes a hydraulically driven cylinder, the hydraulic cylinder being selectively movable between an extended position and a retracted position for moving the movable frame and thus the movable plates of the primary and secondary engaging means. Preferably, the hydraulic cylinder has a cylinder rod which is configured to cause linear movement of the movable frame when the cylinder rod extends or retracts.

To facilitate the forward and backwards linear movement of the movable frame, the movable frame and base are preferably fitted with guide means. Preferably, the guide means includes at least one front guide bar and at least one rear guide bar extending from the movable frame. The at least one front guide bar is arranged to pass through an aperture in a front guide plate and the at least one rear guide bar is arranged to pass through an aperture in a rear guide plate. In one particularly preferred embodiment, there is provided two front guide bars and two rear guide bars.

Preferably, a first pair of side plates is configured to rotate the portion of the blank between that pair of side plate and the mid-plate (i.e. secondary engaging means) in a clockwise direction, and a second pair of side plates is configured to rotate the portion of the blank between that pair of side plates and the mid-plate in a counter-clockwise direction, or vice versa. Again, it will be appreciated that side plates can be mounted to achieve the desired direction of rotation for producing either a right-hand or left-hand twist in the blank.

Each side plate (fixed and movable) is generally trapezoidal in shape, wherein its engaging edge is tapered relative to its mounting formation. To achieve the desired rotation of the blank at the point held between the side plates, the first pair of side plates are arranged such that the tapered edges of the fixed and movable plates in the first pair are substantially parallel and extend at a negative angle (or positive angle for opposite hand formation). Similarly, the second pair of side plates are arranged such that the tapered edges of the fixed and movable plates in the second pair are substantially parallel and extend at a positive angle (or negative angle for opposite hand formation).

It will therefore be appreciated that, due to the tapered engaging edges of the side plates, the relative linear movement between the fixed and movable side plates results in a rotation of the part of the blank between the plates about the mean radius line to produce the desired twist in the blank.

In at least one preferred embodiment, the actuating means is configured such that the apparatus operates with a forming force in the range of 0 to 60 tonne at 200 bar (2,900 psi), and the forming speed is within the range of 0 to 80 mm/s. Embodiments operating within these parameters can be suitable for forming a helical screw from a blank having a thickness in the range of 1 mm to 300 mm.

According to a second aspect of the invention, there is provided a method of forming a helical screw flight, the method including:

providing a flight blank of a predetermined size; and formingly engaging the blank so as to form a twist in at least a portion of the flight blank, the twist substantially corresponding to a predetermined pitch of the flight.

Preferably, the method includes twisting at least a portion of the blank generally about a mean radius line of the blank.

Preferably, the method includes engaging the blank with primary engaging means at at least two spaced apart positions, whereby the primary engaging means is configured to cause relative movement between the at least two engaged positions so as to form the twist in the blank.

The method preferably includes using a secondary engaging means for engaging the blank at at least one position in between the primary engaging means, whereby the engaged portion of the blank on one side of the secondary engaging means is twisted in a first direction and the engaged portion of the blank on the other side of the secondary engaging means is twisted in a second opposed direction.

Preferably, the method includes determining the size of the blank from at least one of a desired pitch, outer diameter, inner diameter, and thickness of the formed helical screw flight.

According to a third aspect of the invention, there is provided a screw (or auger) flight which has been manufactured in accordance with the method of the second aspect of the invention.

According to a fourth aspect of the invention, there is provided a method of setting up an apparatus for forming a helical screw flight from a flight blank, the method including:

securing a central engaging means to the apparatus;

aligning a set up device with the central engaging means;

securing the set up device to the central engaging means in the aligned position;

determining a position for mounting side engaging means relative to the central engaging means with the set up device; and securing the side engaging means to the apparatus at the determined position.

In some preferred embodiments, the method of setting up the apparatus further includes determining the position at which a support bracket is to be secured relative to the side engaging means; and securing the support bracket at the determined position for supporting the flight blank, in use.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Figure 1:
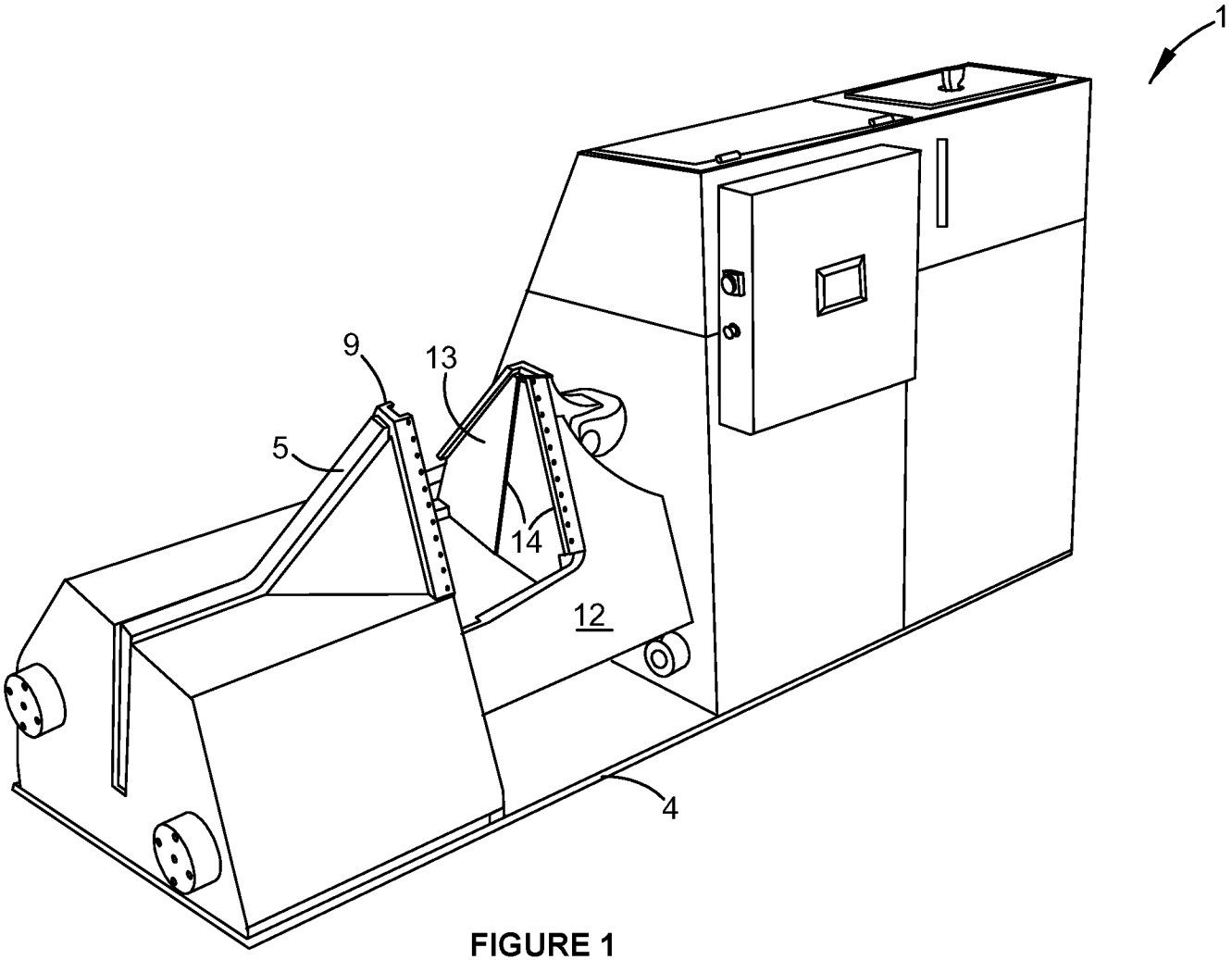
FIG. 1 is a perspective view of an apparatus for forming a helical screw flight according to the invention.
Figure 2:
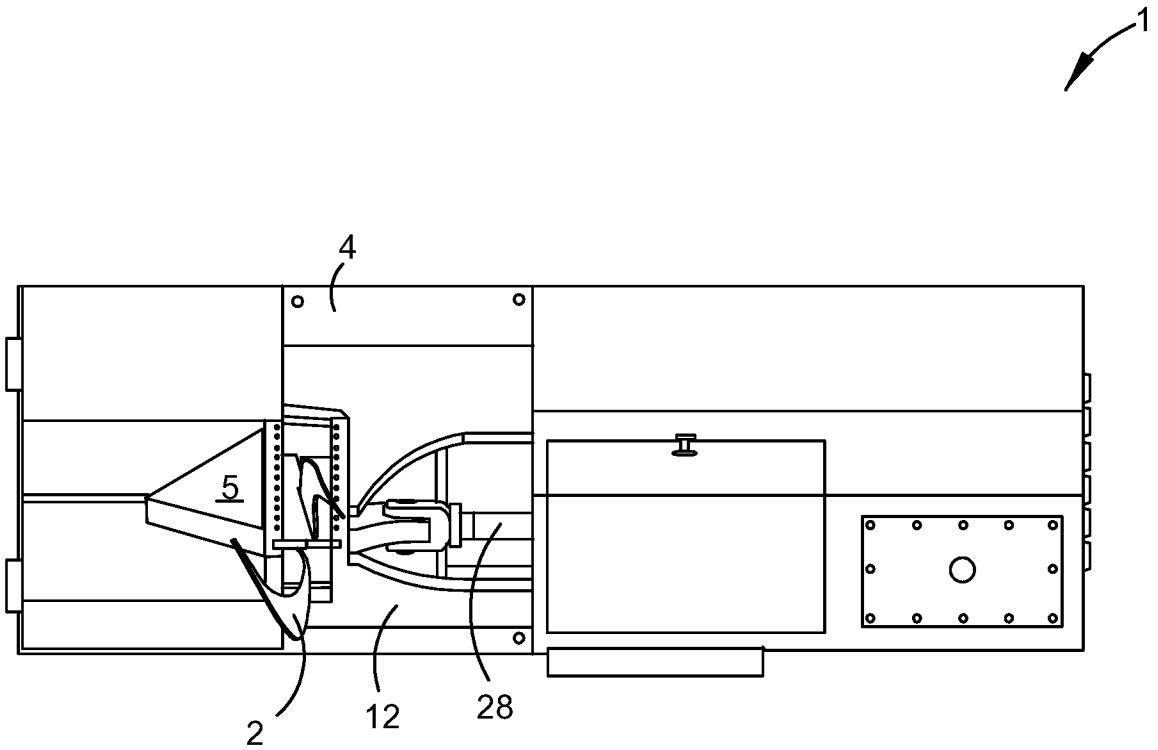
FIG. 2 is a plan view of the flight forming apparatus of FIG. 1.
Figure 3:
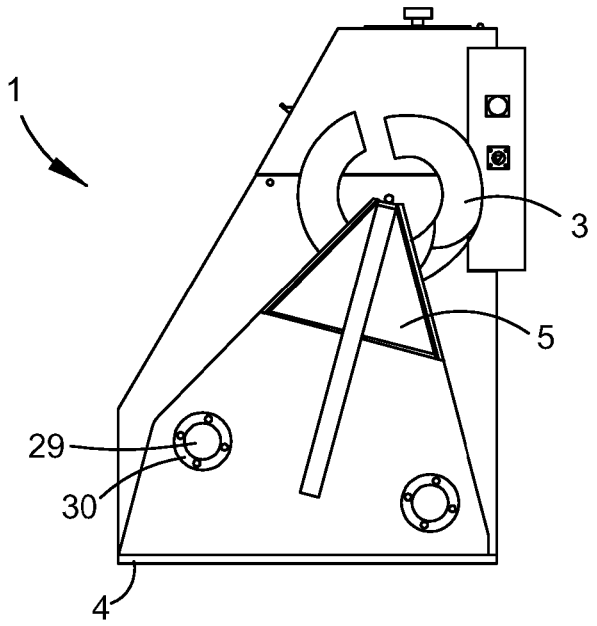
FIG. 3 is a left side view of the apparatus.
Figure 4:
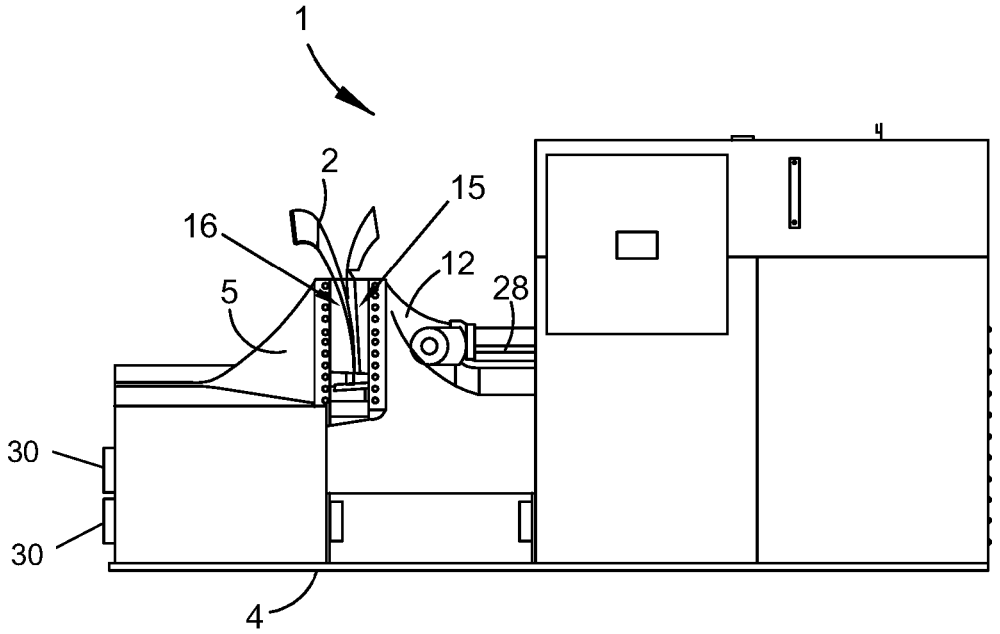
FIG. 4 is a front elevation of the apparatus.
Figure 5:
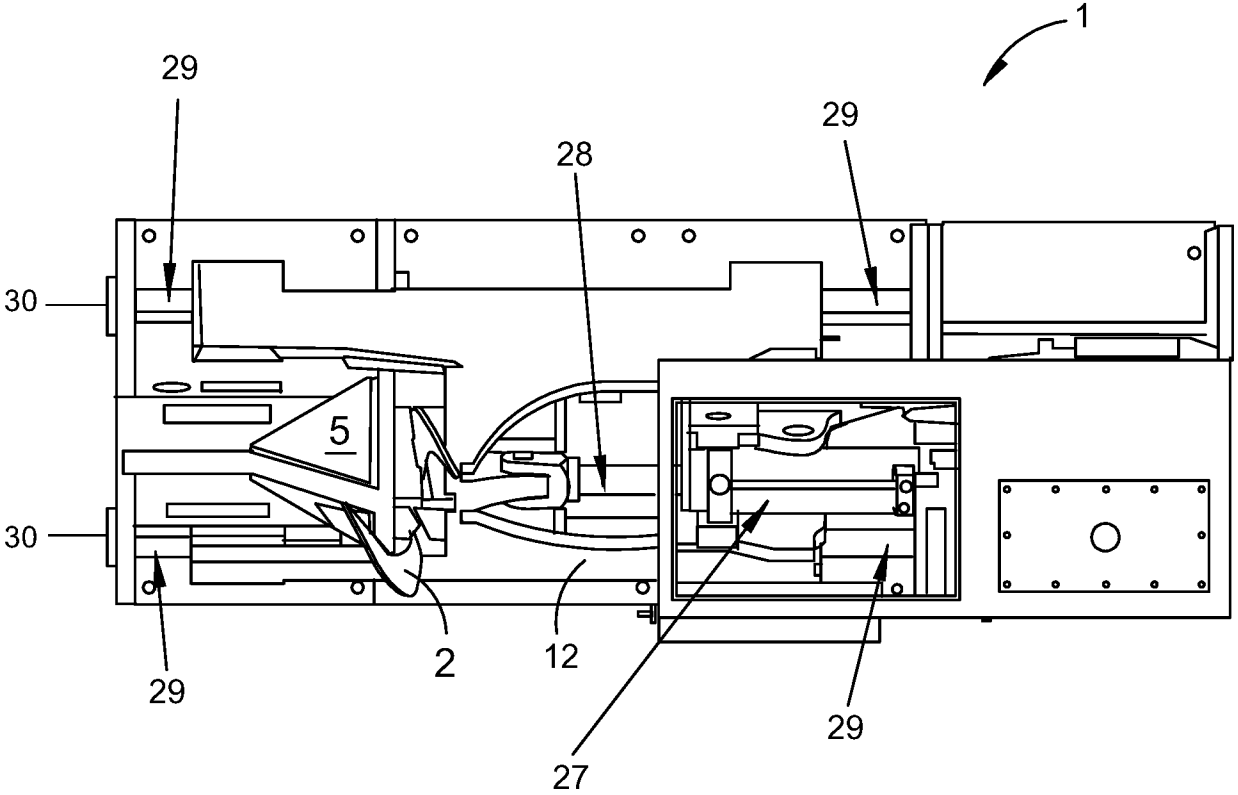
FIG. 5 is a plan view of the apparatus with the sheet metal panel cover removed.
Figure 6:
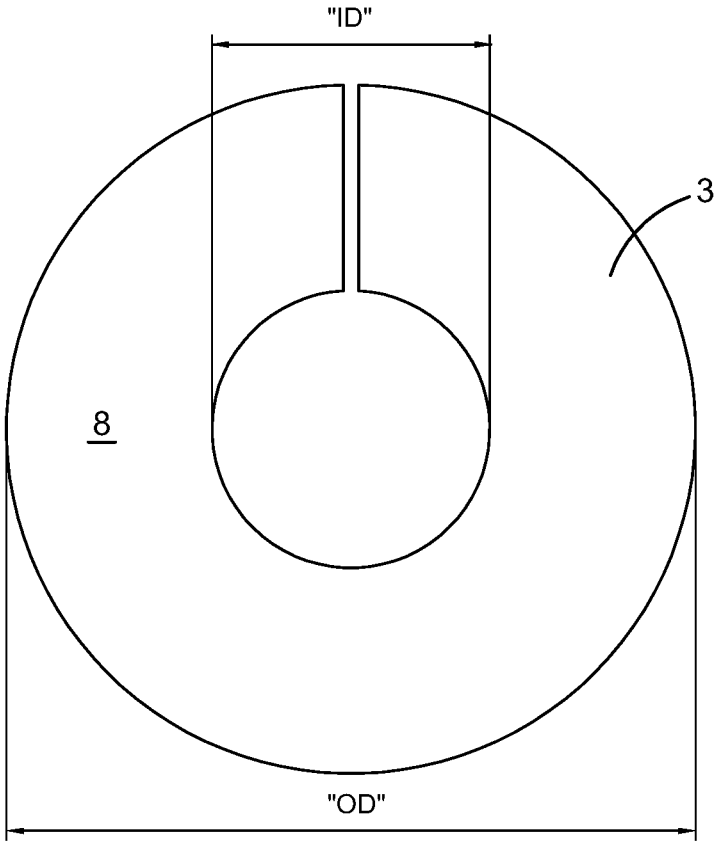
FIG. 6 shows an annulus shaped flight blank.

Referring to the drawings, the invention provides an apparatus 1 for forming a helical screw flight 2 from an open ended annulus shaped flight blank 3. As most clearly shown in FIG. 6, the annulus shaped blank 3 has an inner diameter and an outer diameter.

Figure 7:
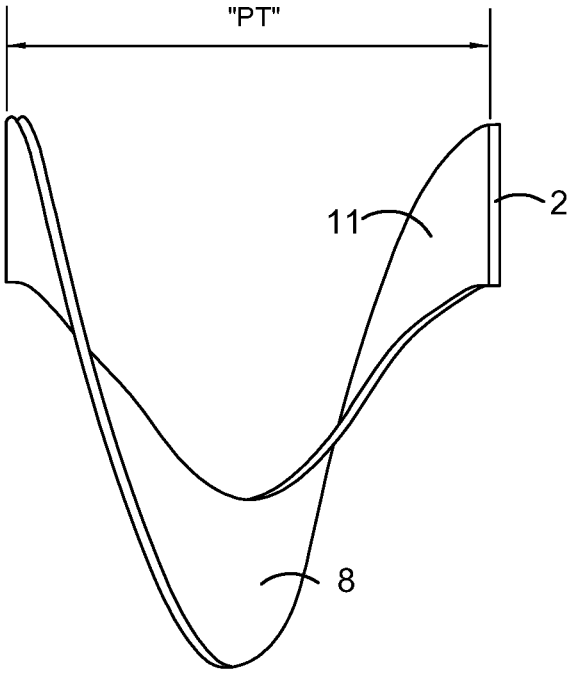
FIG. 7 is a side view of a formed helical screw flight.
Figure 8:
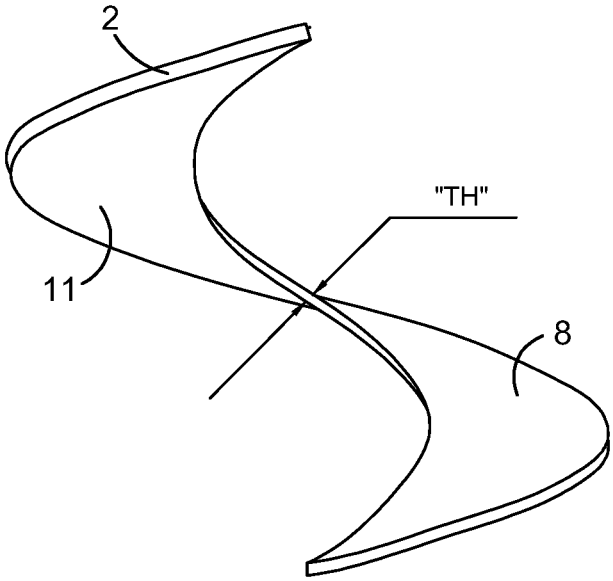
FIG. 8 is a view of the formed flight of FIG. 7 from another side.

The size of the blank 3 is calculated from the values of the desired properties of the helical flight 2 including the inner and outer diameters of the flight 2, the pitch of the flight (FIG. 7) and the thickness of the material used to form the blank/flight (FIG. 8). It will be appreciated by those skilled in the art that the inner and outer diameters of the blank 3 are necessarily greater than those of the formed flight 2.

The flight forming apparatus 1 has a base 4 for resting the apparatus 1 on a supporting surface such as a workshop floor (not shown).

The apparatus 1 includes a mounting means in the form of a mounting frame 5 fixedly connected to the base 4. The fixed mounting frame 5 is configured for mounting a fixed engaging means in the form of two spaced apart side plates 6 and a central or fixed mid-plate 7. As will be described in further detail below, the fixed side plates 6 and the fixed mid-plate 7 are arranged to engage respective spaced apart positions on a first side surface 8 of the flight blank 3.

The fixed mounting frame 5 includes a mounting plate 9 having a receiving formation in the form of three channels 10 for selectively and releasably receiving each fixed plate (6, 7). The channels 10 include a pair of spaced apart side channels for receiving the fixed side plates 6 and a central channel for receiving the fixed mid-plate 7.

Figure 9:
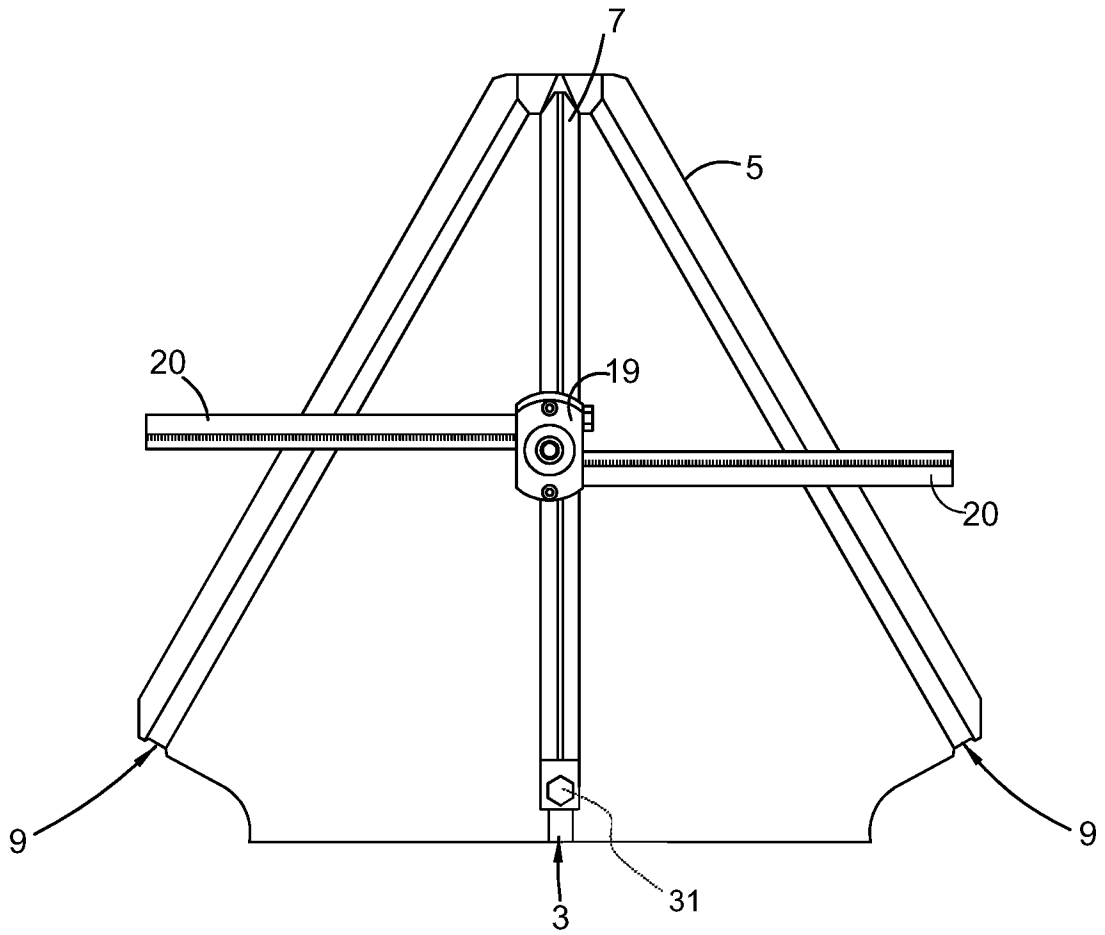
FIG. 9 shows the fixed mounting frame of the apparatus with the mid-plate fixed in position, and a set-up rule assembly mounted to the mid-plate.
Figure 10:
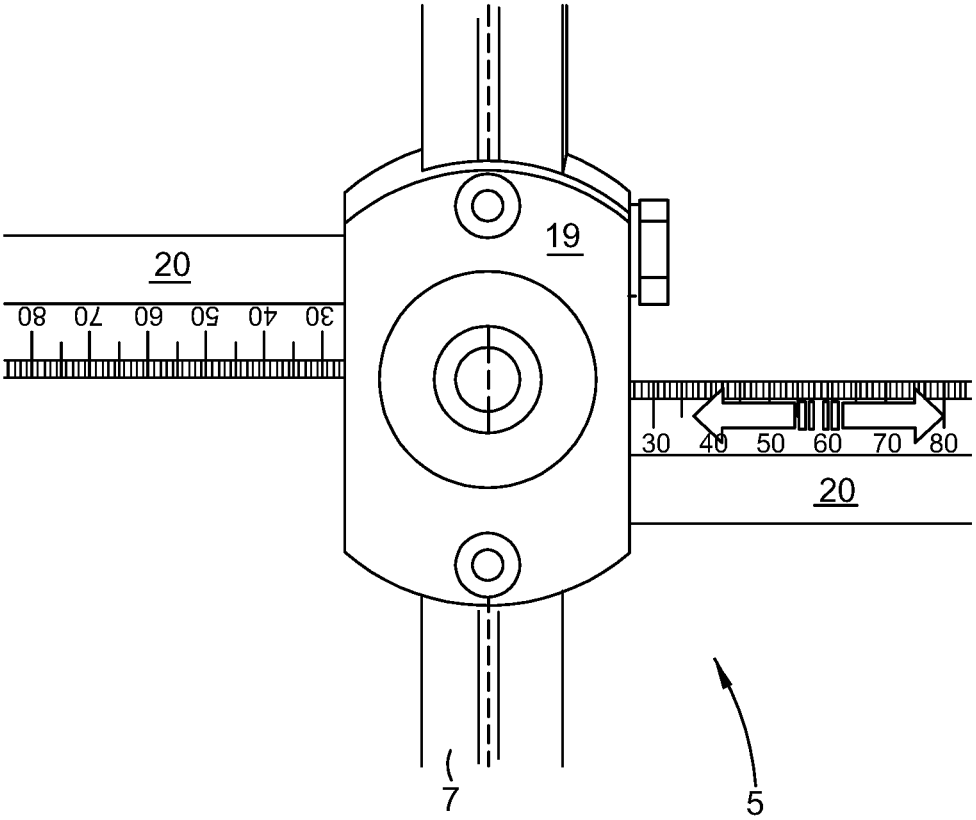
FIG. 10 is an enlarged view of the mid-plate of FIG. 9, showing the alignment with the rule-assembly.

As most clearly shown in FIG. 9, the side channels 10 are symmetrically arranged on either side of the central channel and extend radially at an angle of approximately 60 degrees relative to each other. The side plates 6 and mid-plate 7 can be inserted into and slid along the respective channels 10 to a desired position so as to suit a particular size flight blank 3 and desired pitch of the flight 2.

To engage the opposite second side 11 of the blank 3, the apparatus 1 further includes movable engaging means mounted to a movable frame or carriage 12. The carriage 12 is adapted for relative linear sliding movement with respect to the fixed frame 5.

The carriage 12 has a mounting plate 13 with a receiving formation in the form of three channels 14 for selectively and releasably receiving the movable engaging means.

The movable engaging means is in the form of two movable side plates 15 and a movable mid-plate 16. The channels 14 of the movable mounting plate 13 are arranged to correspond with (or mirror) the channels 10 of the fixed mounting plate 5.

The two pairs of side plates (6, 15) together for a primary engaging means and the pair of mid-plates (7, 16) form a secondary engaging means of the apparatus.

The side and mid-engaging plates (fixed and movable) are preferably die formed components having an engaging edge 17 for engaging the respective surfaces of the blank 3. Each engaging plate is configured so that when it is inserted into its associated channel the engaging edge 17 extends radially, relative to the flight blank 3, so as to be substantially normal to the mean radius line of the blank 3.

Figure 21:
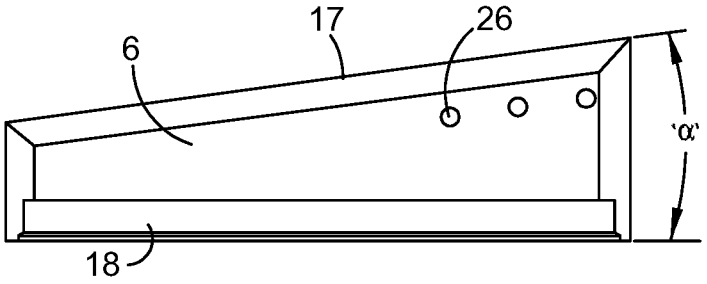
'and FIG. 21 is a side view of a side engaging plate.

As most clearly shown in FIG. 21, each side plate (fixed and movable) is generally trapezoidal in shape and has a mounting formation in the form of a stepped or tongue-shaped edge 18 which can be received in the relevant side channel (10, 14) of the fixed or movable mounting plate (5, 13). The engaging edge 17 is tapered relative to the mounting formation so as to extend at a predetermined die plate angle '$\alpha$' relative to the mounting edge 18. The die plate angle '$\alpha$' is calculated to suit the desired pitch of the flight 2. Accordingly, it will be appreciated that sets of engaging plates with various die plate angles '$\alpha$' can advantageously be manufactured and used, interchangeably, as required to manufacture helical flights 2 of various pitches.

In order to achieve the desired rotation (twist) of the blank 3 at the points held between the side plates, one pair of side plates are arranged such that the tapered edges 17 of the fixed and movable plates in this pair are substantially parallel and extend at a negative angle. Similarly, the second pair of side plates is arranged such that the tapered edges 17 of the fixed and movable plates in this pair are substantially parallel and extend at a positive angle.

It will therefore be appreciated that, due to the tapered engaging edges 17 of the side plates, the relative linear movement between the fixed and movable side plates results in a rotation of the part of the blank between the side plates about the mean radius line to produce the desired twist in the blank. In the figures, the front pair of side plates extend at a negative angle and are therefore configure to rotate that portion of the blank in a counter-clockwise direction. The rear pair of side plates extend at a positive angle and are therefore configure to rotate that portion of the blank in a clockwise direction. It will of course be appreciated by those skilled in the art that the plates can be readily interchanged so the front and rear pairs of side plates extend at opposite angles to produce a flight of different hand (e.g. a left or right hand flight).

To secure the mid-plates (7, 16) in position, a locking means in the form of a lock-bolt 31 (FIG. 9) is provided for locking the mid-plates relative to the respective mounting plates (9, 13).

Figure 11:
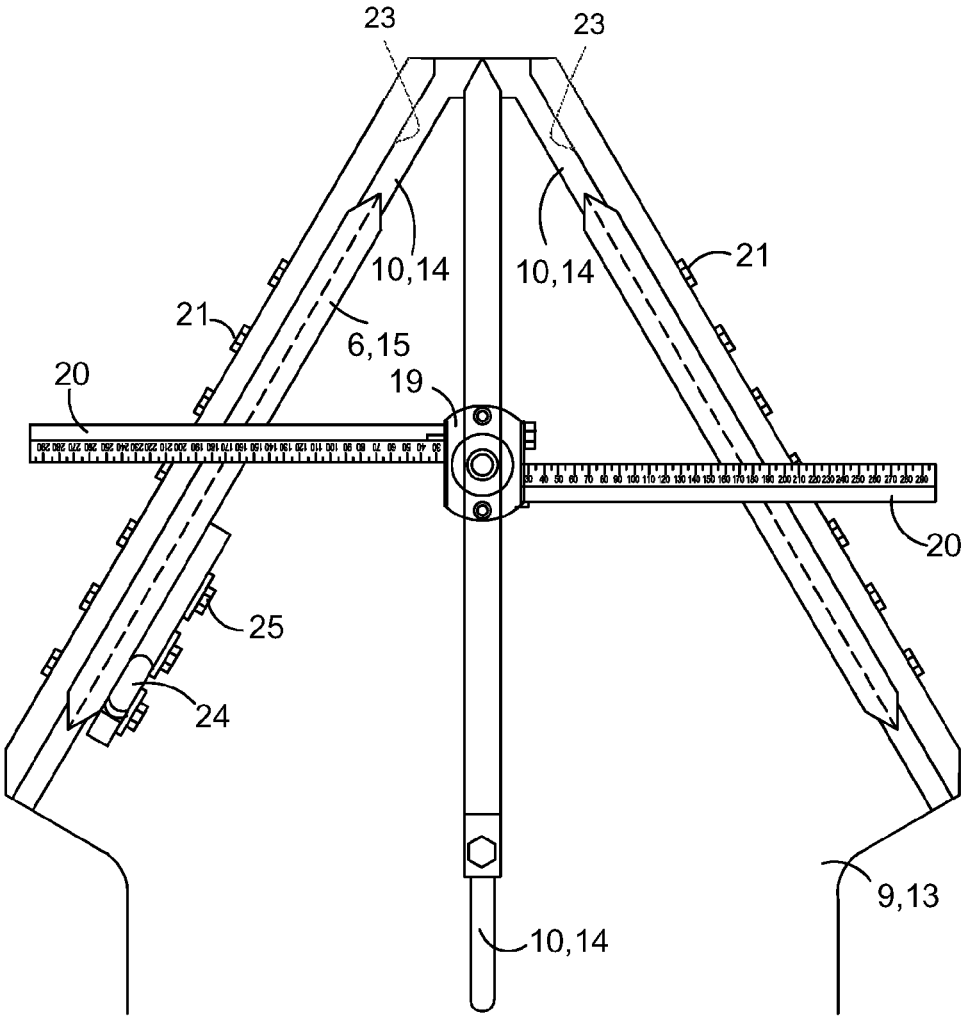
FIG. 11 shows the base offset between each fixed side plate and the mid-plate, and the support offset for a support bracket mounted to a side plate.
Figure 12:
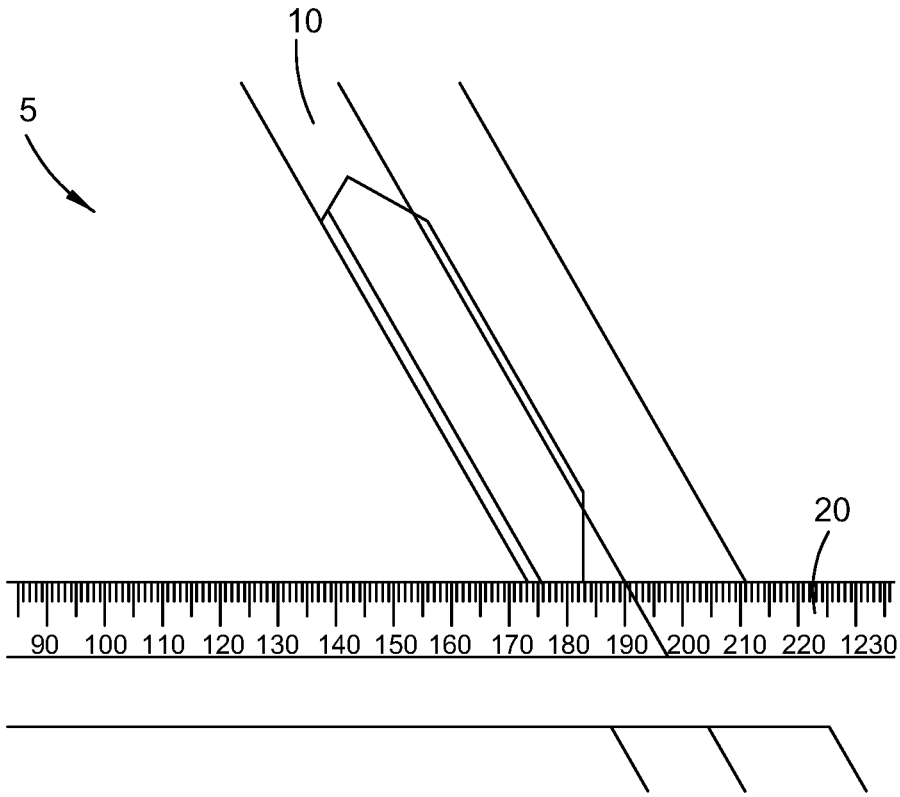
FIG. 12 is an enlarged view of a rule guide used with rule-assembly for setting the base offset.
Figure 13:
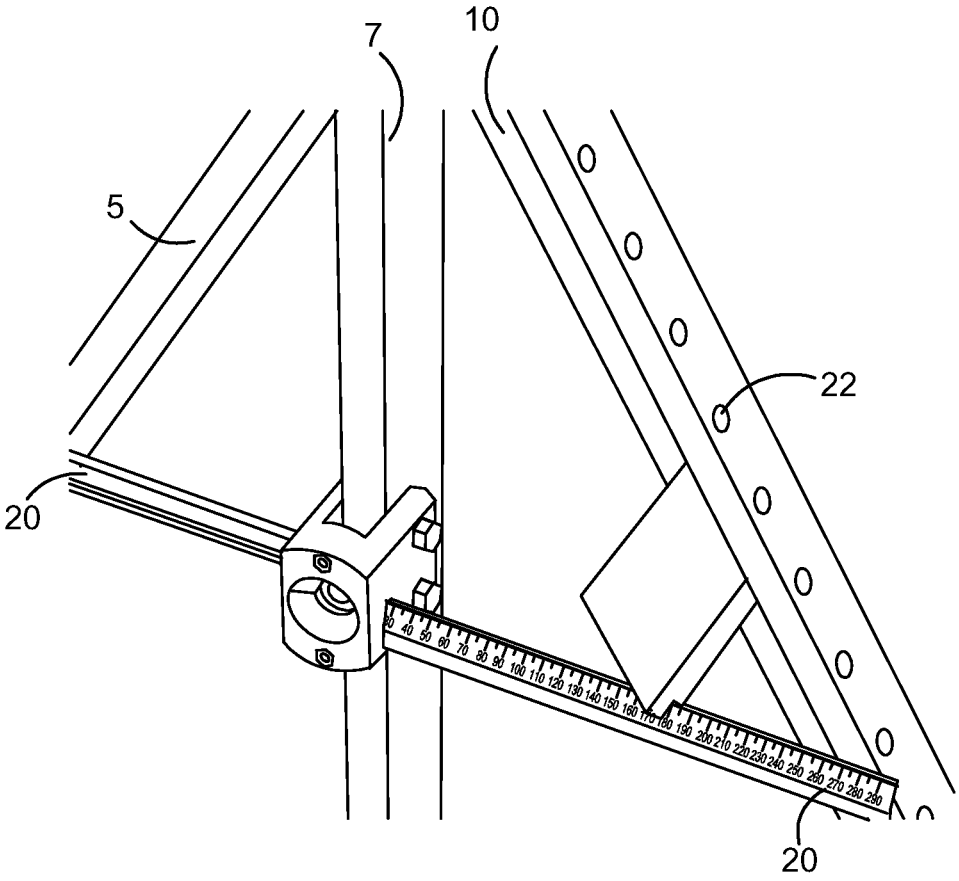
FIG. 13 is a perspective view of the rule guide of FIG. 12.
Figure 14:
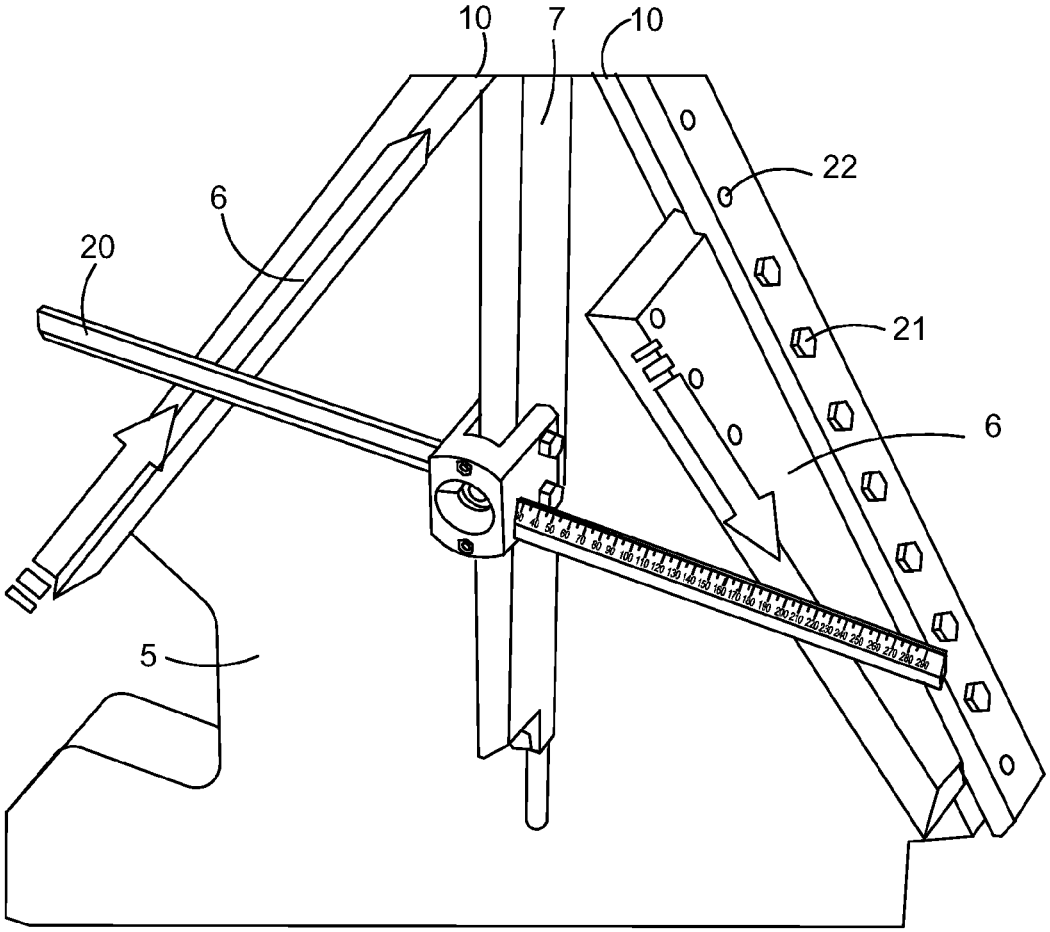
FIG. 14 is schematic view showing setup of the fixed side plates.
Figure 15:
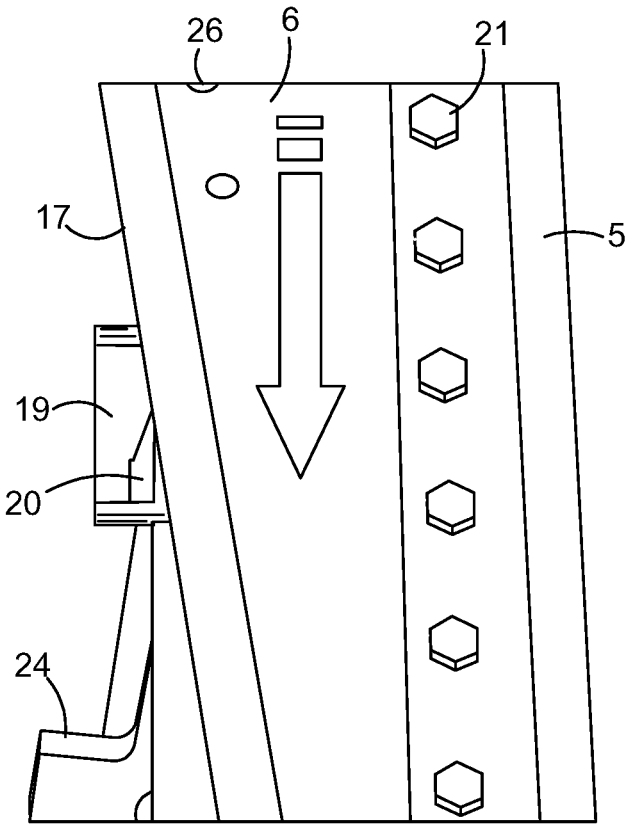
FIG. 15 is an enlarged side view of FIG. 14.
Figure 16:
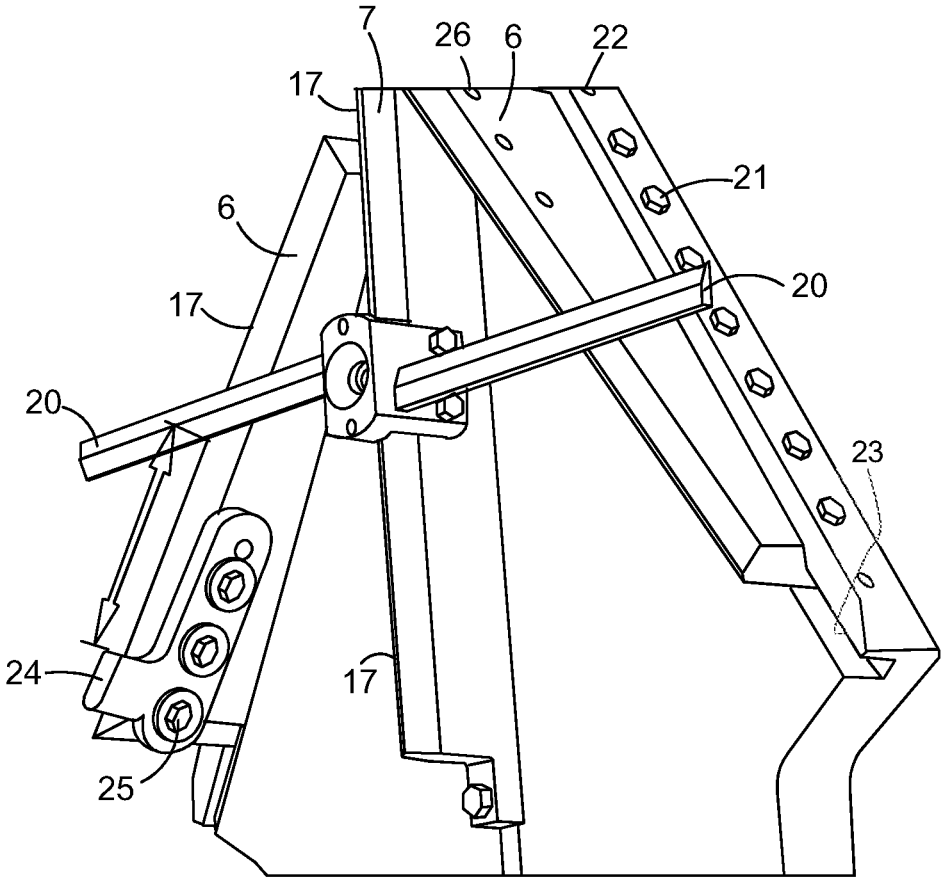
FIG. 16 is a perspective view showing setup of the a support bracket.
Figure 17:
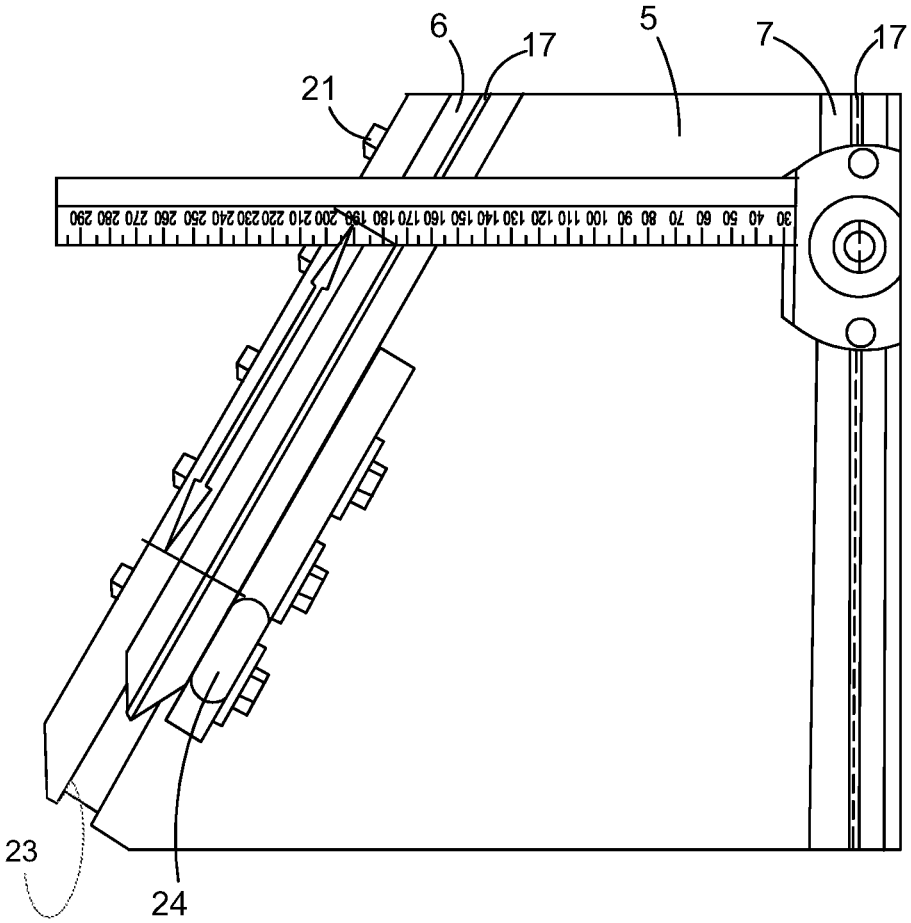
FIG. 17 is an enlarged view of the support bracket setup of FIG. 16.
Figure 18:
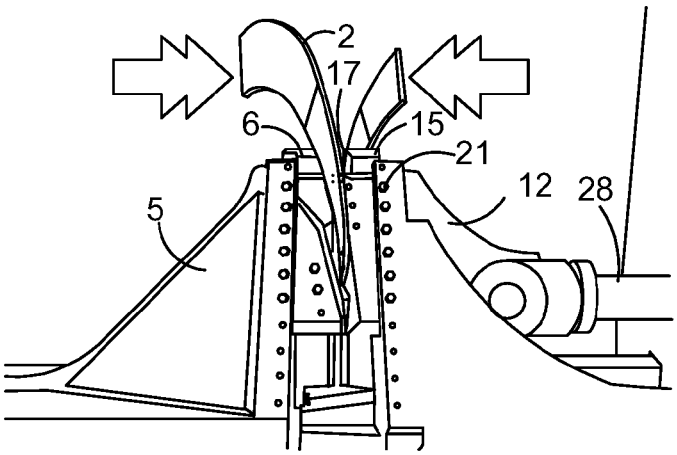
FIG. 18 is a side view of the engaging means showing the primary and secondary engaging plates in forming engagement with the blank.
Figure 19:
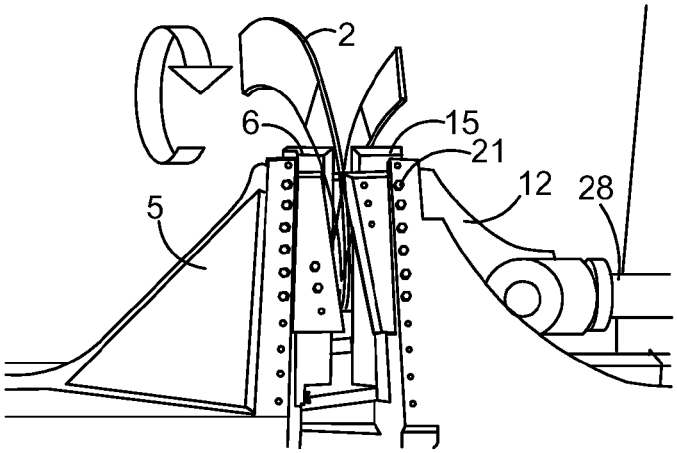
FIG. 19 is a side view of the engaging means with the hydraulic cylinder in a partially extended position such that a roll gap exists between the fixed and movable plates to enable manipulation of the blank.
Figure 20:
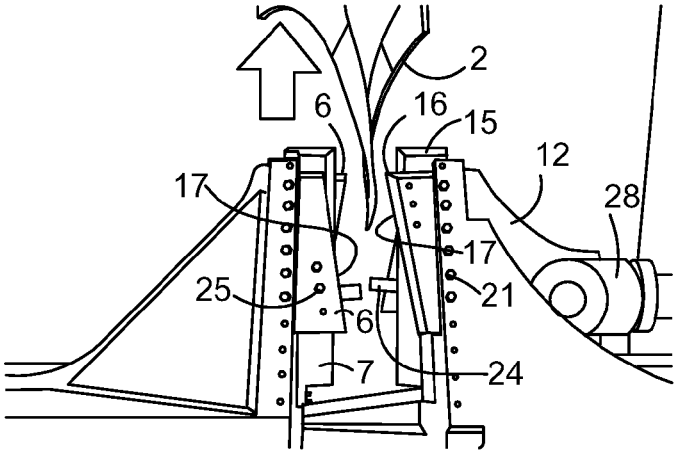
FIG. 20 is a side view of the engaging means with the hydraulic cylinder in its retracted position to enable insertion of a blank and extraction of a formed flight.

With reference to FIGS. 9 to 17, once the mid-plates (7, 16) are securely locked in position, a set up device having a mounting bracket 19 and a pair of oppositely directed rulers 20 is mounted on the mid-plate (7, 16). The set up device is used to determine the correct positioning of the side plates (6, 15) in their respective side channels, relative to the mid-plate. As best seen in FIG. 11, the engaging edge 17 of the side plates are positioned at a predetermined base offset distance from the mid-plate. As the side plates (6, 15) are oppositely tapered, the side plate on the right of FIG. 11 is slid downwardly along its channel (10, 14) until its engaging edge 17 meets the ruler 20 at the base offset distance. Due to the opposite taper, the side plate on the left of FIG. 11 is slid upwardly along its channel (10, 14) until its engaging edge 17 meets the ruler 20 at the base offset distance.

The side plates (6, 15) are secured in position in the respective channels (10, 14) by securing means in the form of a plurality of locking screws 21. The locking screws 21 pass through holes 22 in the side wall 23 of the channel and securingly engage the mounting tongue 18 of the associated side plate (6, 15). In the illustrated embodiment, as best seen in FIG. 11, seven locking screws 21 are used to secure each side plate (6, 15).

Referring again to FIG. 11, a support means in the form of a pair of support brackets 24 is provided for supporting the flight blank 3, in use. One support bracket 24 is attached to the fixed side plate of the first pair of primary engaging plates and a second support bracket is attached the movable side plate of the second pair of primary engaging plates. The support brackets 24 are selectively adjustably positionable relative to the associated side plate and secured thereto by a suitable locking means in the form of locking bolts 25. In the illustrated embodiment, three locking bolts 25 are used to secure the support bracket 24 to the associated side plate (6, 15). As most clearly shown in FIG. 21, the side plates (6, 15) have three apertures 26 through which the locking bolts 25 pass to hold the support bracket 24 relative to the side plate (6, 15).

The apparatus 1 further includes an actuating means in the form of a hydraulically driven cylinder 27 having a cylinder rod 28 coupled to the carriage 12. The coupling arrangement is such that movement of the cylinder rod 28 causes a corresponding linear movement of the carriage 12. The movement of the cylinder rod 28 is selectively controllable between an extended position and a retracted position so as to control the relative spacing between the fixed and movable plates of the primary and secondary engaging means.

To facilitate the forward and backwards linear movement of the movable frame 12 and, in particular, to enhance the accuracy of this movement, front and rear guide bars 29 are fitted to and extend from the carriage 12. The front and rear guide bars 29 are arranged to slidably pass through guide sleeves 30 fixed on or relative to the base 4.

In use, the apparatus 1 is initially started with the cylinder rod 28 in its retracted position to enable a new flight blank 3 to be placed between the fixed and movable engaging plates (6, 7, 15, 16). The cylinder rod 28 is then extended to move the carriage 12 to an intermediate position between the fully retracted and extended positions. In the intermediate position, the blank 3 can be supported on the support brackets 24.

The cylinder rod 28 is then actuated to extended at a predetermined forming speed to bring the side and mid-plates into forming engagement with the respective surfaces (8, 11) of the blank 3. The plates are configured such that the front pair of side plates rotate the portion of the blank between that pair of side plates and the mid-plates in a counter-clockwise direction, and the rear pair of side plates is configured to rotate the portion of the blank between that pair of side plates and the mid-plates in a clockwise direction.

As the engaging plates extend substantially normal to the mean radius line of the annulus, the rotation induced by the engaging plates forms a twist in the engaged portion of the annulus about the mean radius line of the annulus. It will be appreciated by those skilled in the art that, by twisting the blank about its mean radius line, undesirable rounding, coning or rolling across the cross-section of the blank is substantially avoided.

Once the form twisting process has been done, the cylinder rod 28 is retracted to its intermediate position and the blank 3 is rolled on the support brackets 24 to bring the next section of blank into position and the forming process is repeated. These steps are repeated until the entire blank 3 has been twisted and the helical flight 2 is complete.

Accordingly, the present invention in various embodiments thus overcomes a number of problems and provides a number of advantages. Preferred embodiments of the invention provide an efficient apparatus for forming a helical screw flight which, due to the use of interchangeable engaging plates, enables flights of various sizes, pitches and hands to be readily formed in a cost effective manner. The interchangeable plates also provide advantages in terms reduced tooling costs as sets of plates can be produced and used as desired. Set-up times are also reduced with further associated cost saving advantages through the reduction in the manual labour input required. By engaging the blank in a radial manner, the apparatus advantageously forms the desired twist in the blank around the mean radius line without plastically working the blank. The radial engagement also advantageously inhibits undesirable rolling, rounding or coning of the edges which can adversely affect material transfer and flow rates. Preferred forms of the apparatus are easy to install, set up and use and provide improvements in accuracy to design requirements. In these and other respects, the invention in its preferred embodiments, represents a practical and commercially significant improvement over the prior art.

Although the invention has been described with reference to specific examples, it will be appreciated by those skilled in the art that the invention may be embodied in many other forms.

The claims defining the invention are as follows:

1. An apparatus for forming a helical screw flight from an open ended annulus shaped blank, the apparatus including:

a base;

a fixed mounting frame arranged on the base;

a pair of selectively interchangeable fixed side plates releasably mounted to the fixed mounting frame so as to be angled relative to one another, wherein the angle between the fixed side plates is less than 90 degrees, and wherein each fixed side plate has an engaging portion for engaging a first side of the annulus shaped blank along a line normal to a mean radius line of the annulus shaped blank;

a movable mounting frame arranged on the base, the movable mounting frame being selectively movable relative to the fixed mounting frame; and a pair of selectively interchangeable movable side plates releasably mounted to the movable mounting frame so as to be angled relative to one another, wherein the angle between the movable side plates is such that the movable side plates are aligned with the corresponding fixed side plates, and wherein each movable side plate has an engaging portion for engaging an opposed second side of the annulus shaped blank along a line normal to a mean radius line of the annulus shaped blank;

wherein, the fixed and movable plates are adapted to formingly engage the blank upon movement of the movable mounting frame towards the fixed mounting frame, thereby forming a twist in at least a portion of the flight blank between the side plates.

2. An apparatus according to claim 1, including a secondary engaging element for engaging the blank at at least one position between the respective pairs of side plates.

3. An apparatus according to claim 2, wherein the secondary engaging element engages the blank at a mid-point between the respective pairs of side plates.

4. An apparatus according to claim 3, wherein the secondary engaging element includes a pair of mid-plates.

5. An apparatus according to claim 4, wherein the mid-plates include a fixed mid-plate releasably mounted to the fixed mounting frame and a movable mid-plate releasably mounted to the movable mounting frame, whereby the movable mid-plate is movable relative to the fixed mid-plate.

6. An apparatus according to claim 5, wherein the fixed and movable mid-plates are respectively adapted to engage the first and second sides of the annulus shaped blank along a line normal to the mean radius line of the blank.

7. An apparatus according to claim 1, wherein the angle between the fixed side plates is 60 degrees.

8. An apparatus according to claim 1, wherein the angle between the fixed side plates is 30 degrees.

* * * * *